US008309232B2

(12) United States Patent
Daeubler et al.

(10) Patent No.: US 8,309,232 B2
(45) Date of Patent: Nov. 13, 2012

(54) RUNNING-IN COATING FOR GAS TURBINES AND METHOD FOR PRODUCTION THEREOF

(75) Inventors: Manfred A. Daeubler, Dachau (DE); Klaus Schweitzer, Niederpoecking (DE)

(73) Assignee: MTU Aero Engines GmbH, Munich (DE)

( * ) Notice: Subject to any disclaimer, the term of this patent is extended or adjusted under 35 U.S.C. 154(b) by 1777 days.

(21) Appl. No.: 10/581,147

(22) PCT Filed: Nov. 12, 2004

(86) PCT No.: PCT/DE2004/002508

§ 371 (c)(1), (2), (4) Date: May 31, 2006

(87) PCT Pub. No.: WO2005/056878

PCT Pub. Date: Jun. 23, 2005

(65) Prior Publication Data

US 2008/0282933 A1 Nov. 20, 2008

(30) Foreign Application Priority Data

Dec. 5, 2003 (DE) ..... 103 56 953

(51) Int. Cl.
*B32B 15/01* (2006.01)
*B32B 15/00* (2006.01)
*F01D 25/00* (2006.01)

(52) U.S. Cl. ..... 428/668; 428/553; 428/679; 428/680; 415/174.4; 427/456; 427/455; 427/256

(58) Field of Classification Search ..... None
See application file for complete search history.

(56) References Cited

U.S. PATENT DOCUMENTS

| | | | | |
|---|---|---|---|---|
| 5,047,612 | A | 9/1991 | Savkar et al. | 219/121.47 |
| 5,529,809 | A | 6/1996 | Glovan et al. | 427/422 |
| 5,536,022 | A | 7/1996 | Sileo et al. | 277/235 A |
| 5,879,753 | A | 3/1999 | Zajchowski et al. | 427/454 |
| 5,912,471 | A | 6/1999 | Schütz | 250/559.4 |
| 6,547,522 | B2 * | 4/2003 | Turnquist et al. | 415/173.3 |
| 6,969,231 | B2 * | 11/2005 | Ghasripoor et al. | 415/173.4 |
| 7,165,946 | B2 * | 1/2007 | Nava et al. | 416/241 R |
| 7,255,929 | B2 * | 8/2007 | Turnquist et al. | 428/573 |
| 2002/0192074 | A1 * | 12/2002 | Turnquist et al. | 415/173.3 |
| 2005/0129976 | A1 * | 6/2005 | Turnquist et al. | 428/680 |
| 2005/0281668 | A1 * | 12/2005 | Nava et al. | 415/173.4 |
| 2007/0132193 | A1 * | 6/2007 | Wolfe et al. | 277/415 |

FOREIGN PATENT DOCUMENTS

EP 1 270 876 1/2003

* cited by examiner

*Primary Examiner* — Jennifer McNeil
*Assistant Examiner* — Jason Savage
(74) *Attorney, Agent, or Firm* — Davidson, Davidson & Kappel, LLC

(57) ABSTRACT

A running-in coating for gas turbines and a method for production of a running-in coating are provided. The running-in coating serves to seal a radial gap between a housing (11) of the gas turbine and the rotating blades (10) themselves, whereby the running-in coating (13) is applied to the housing. The running-in coating is made from a CoNiCrAlY-hBN material. The CoNiCrAlY-hBN material can be applied by thermal spraying, in particular plasma spraying.

23 Claims, 2 Drawing Sheets

RUNNING-IN COATING FOR GAS TURBINES AND METHOD FOR PRODUCTION THEREOF

FIELD OF THE INVENTION

The present invention relates to a running-in coating for gas turbines and a method for producing a running-in coating.

BACKGROUND

Gas turbines, such as aircraft engines, include as a rule multiple stages with rotating blades and stationary guide blades, the rotating blades rotating together with a rotor and the rotating blades as well as the guide blades being enclosed by a stationary housing of the gas turbine. For enhancing the power of an aircraft engine it is important to optimize all components and subsystems. This includes the sealing systems in aircraft engines. It is particularly problematic in aircraft engines to maintain a minimum gap between the rotating blades and the stationary housing of a high-pressure compressor. The highest temperatures as well as the greatest temperature gradients occur in high-pressure compressors, which makes it complicated to maintain the gap between the rotating blades and the stationary housing of the compressor. This, among other things, is the reason for dispensing with shroud bands on compressor rotating blades, such as are used in turbines.

As mentioned above, rotating blades in the compressor do not have a shroud band. Therefore, the ends or tips of the rotating blades are exposed to a direct frictional contact with the housing during the rubbing into the stationary housing. Such a rubbing of the tips of the rotating blades into the housing is caused by manufacturing tolerances during adjustment of a minimum radial gap. Since material is removed from the rotating blades due to the frictional contact of the tips of the rotating blades, an undesirable enlargement of the gap may occur over the entire circumference of the housing and the rotor. In order to prevent this, it is known from the related art to armor the ends or tips of the rotating blades using a hard coating or abrasive particles. However, such blade tip armoring is very expensive.

Another way to avoid the wear at the tips of the rotating blades and to provide an optimized seal between the ends or tips of the rotating blades and the stationary housing is coating the housing with a running-in coating. When material is removed on a running-in coating, the radial gap is not enlarged over the entire circumference, but as a rule only in a sickle shape in one or in multiple sectors, thereby reducing a power drop of the engine. Housings having a running-in coating are known from the related art.

A running-in coating for the housing of a high-pressure compressor is known from the related art, the running-in coating being made of a NiCrAl-bentonite material. Such a running-in coating made of a nickel-chromium-aluminum-bentonite material is particularly well suited for rotating blades which are made of a nickel material or a nickel-based alloy. However, it has become apparent that such a running-in coating is not suitable for blades made of a titanium material or a titanium-based alloy. Unarmored blade tips of blades made of a titanium-based material are damaged when a NiCrAl-bentonite material is used. Therefore, according to the related art, the blade tips of rotating blades made of a titanium-based material must be armored for temperatures higher than 480° C. when such a running-in coating is used. There is no running-in coating known from the related art with the aid of which armoring of the blade tips may be dispensed with, both in the case of rotating blades made of a nickel-based material and of rotating blades made of a titanium-based material.

SUMMARY OF THE INVENTION

Based on this fact, the object of the present invention is to create a novel running-in coating for gas turbines as well as a method for manufacturing same.

The running-in coating for gas turbines according to the present invention is used for sealing a radial gap between a stationary housing of the gas turbine and rotating blades of the same. The running-in coating is attached to the housing and is made of a CoNiCrAlY-hBN material.

According to an advantageous embodiment of the present invention, the running-in coating has a density and a porosity such that is has a relatively low Rockwell hardness, the Rockwell hardness being in a range of 20 to 60, in particular in a range of 35 to 50, and is a Rockwell hardness determined by the HR 15Y scale.

Another advantageous embodiment of the present invention provides a method for manufacturing a running-in coating for gas turbines for sealing a radial gap between a housing of the gas turbine and rotating blades of the same, comprising applying a running-in coating including CoNiCrAlY-hBN to the housing.

BRIEF DESCRIPTION OF THE DRAWINGS

Exemplary embodiments of the present invention, without being limited thereto, are explained in greater detail in the following on the basis of the drawing.

DETAILED DESCRIPTION

Figure 1:
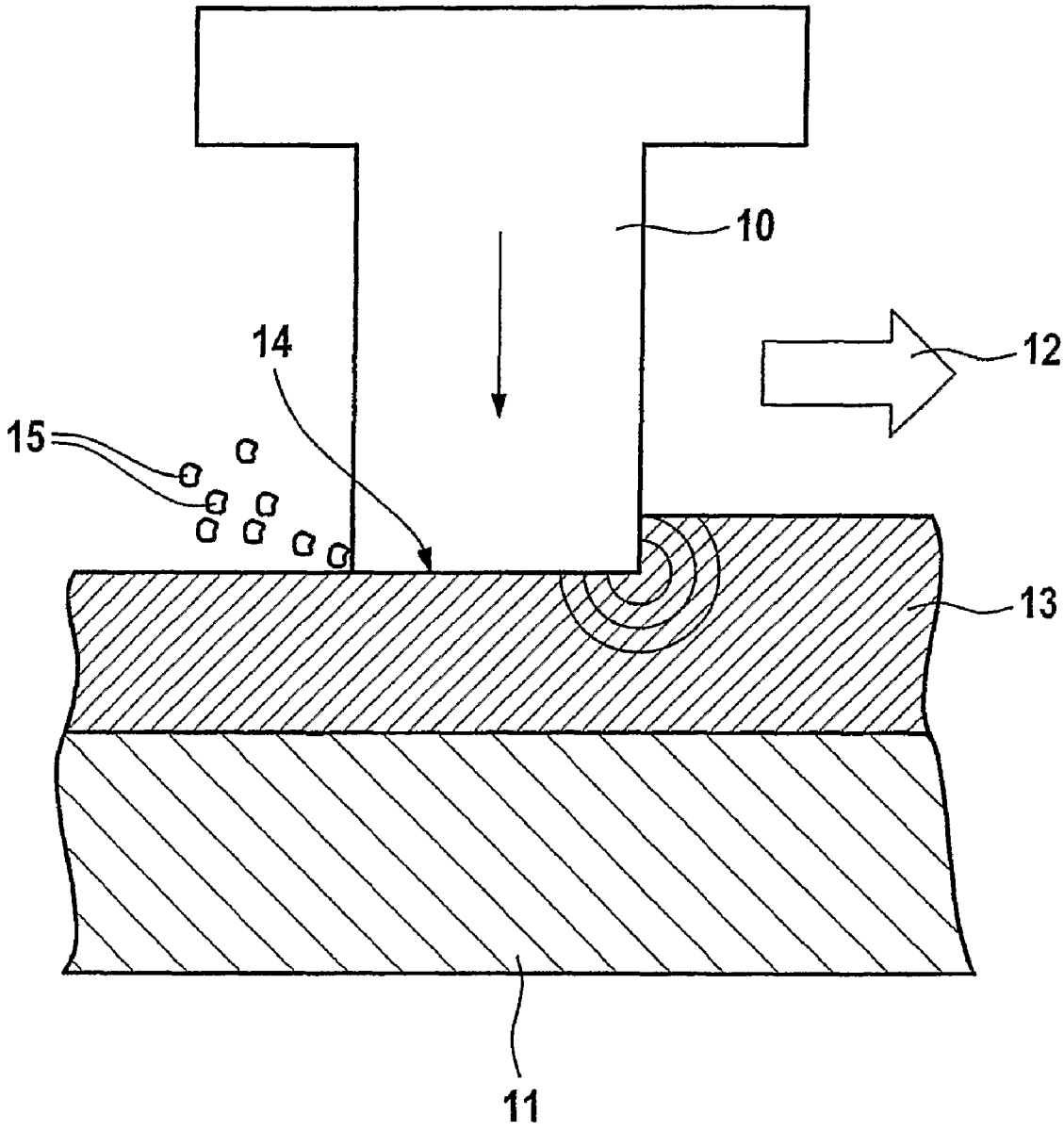
FIG. 1 shows a highly schematic representation of a rotating blade of a gas turbine together with a housing of the gas turbine and a running-in coating attached to the housing.

Highly schematized, FIG. 1 shows a rotating blade 10 of a gas turbine which rotates with respect to a stationary housing 11 in the direction of arrow 12. An running-in coating 13 is situated on housing 11. Running-in coating 13 is used for sealing a radial gap between a tip or an end 14 of rotating blade 10 and stationary housing 11. According to the preferred exemplary embodiment, housing 11, schematically represented in FIG. 1, is the housing of a high-pressure compressor.

The demands made on such a running-in coating are very complex. The running-in coating must have optimized abrasion characteristics, i.e., a good splittability and removability of the abrasion must be ensured. Moreover, no material transfer onto rotating blades 10 may take place. Furthermore, running-in coating 13 must have a low frictional resistance. Furthermore, running-in coating 13 may not ignite when rubbing against rotating blades 10. As an example, erosion resistance, thermal stability, thermal shock stability, and corrosion resistance vis-à-vis lubricants and seawater should be mentioned as further demands made on running-in coating 13. FIG. 1 clarifies that, due to the centrifugal forces and the heating of the gas turbine during operation of the gas turbine, ends 14 of rotating blades 10 come in contact with running-in coating 13, thereby releasing rubbed-off particles 15. This pulverized abrasion 15 may not cause damage to rotating blades 10.

As defined in the present invention, running-in coating 13 is made of a cobalt (Co)-nickel (NI)-chromium (Cr)-aluminum (Al)-yttrium (Y) material mixed with hexagonal boron nitride (hBN). The CoNiCrAlY-hBN running-in coating 13 possesses a relatively low hardness. The Rockwell hardness of running-in coating 13 is in a range of 20 to 60, preferably in a range of 35 to 50, the Rockwell hardness being determined according to the HR 15Y scale. This is achieved by incorporating pores in the CoNiCrAlY-hBN material. The porosity determines the density and thus the hardness of running-in coating 13.

Figure 2:
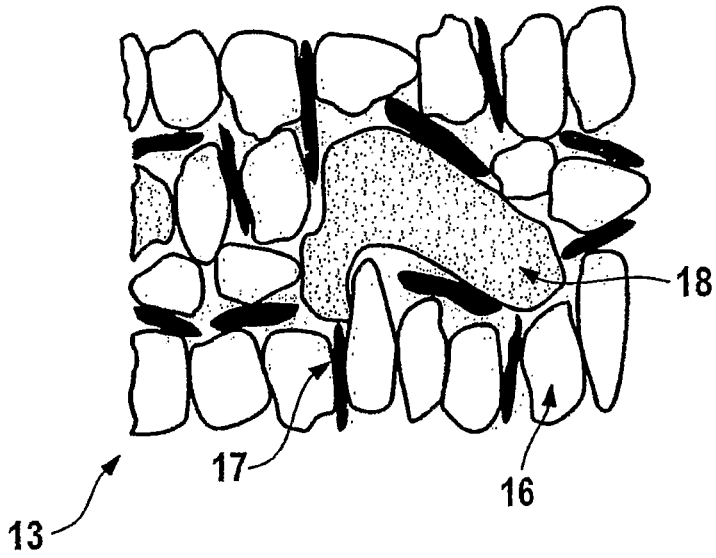
FIG. 2 shows a schematic representation of the running-in coating.

FIG. 2 shows the schematic configuration of running-in coating 13. Particles 16 from the CoNiCrAlY alloy matrix together with particles 17 made of hexagonal boron nitride (hBN) form running-in coating 13, pores 18 being incorporated between particles 16 and 17. The number of pores 18 also determines the density of running-in coating 13 and thus its Rockwell hardness. CoNiCrAlY particles 16 form the supporting structure. Incorporated hexagonal boron nitride particles 17 form predetermined breaking points of running-in coating 13 due to their graphite-like splittability.

As mentioned above, the Rockwell hardness of running-in coating 13 according to the present invention is in a range between 20 and 60, preferably in a range between 35 and 50. The Rockwell hardness is determined by the HR 15Y scale. This means that a half-inch (½") steel ball is used with a test load of 147 N (15 kp) as a penetrator during the hardness test. The number 15 in the HR 15Y hardness scale thus indicates the test load and the symbol Y in the HR 15Y scale indicates the penetrator used. The test pre-load in this hardness test method according to Rockwell is preferably 29.4 N (3 kp). The details of the hardness test according to Rockwell are familiar to those skilled in the art who are addressed here.

It is therefore the object of the present invention to manufacture running-in coating 13 for the housing of a high-pressure compressor using a CoNiCrAlY-hBN material, hexagonal boron nitride (hBN) being exclusively used. Moreover, it is the object of the present invention to establish the porosity and thus the density or hardness of the running-in coating in such a way that the Rockwell hardness of running-in coating 13, determined with the aid of the HR 15Y scale, is in a range of 20 to 60, preferably in a range of 35 to 50. Such a running-in coating 13 is suitable for rotating blades made of a nickel-based material as well as for rotating blades made of a titanium-based material and blade tip armoring may thus be dispensed with for both types of rotating blades. The costs for blade tip armoring may thus be reduced. Moreover, it is an advantage that running-in coating 13 according to the present invention has good abrasive characteristics as well as good erosion resistance and oxidation resistance. In addition, running-in coating 13 has good heat-insulating properties so that the overall thickness of running-in coating 13 may be reduced. This also reduces material costs and furthermore reduces weight. Overall, the power ratio of the gas turbine may be optimized and it may be operated with a lower fuel consumption.

Running-in coating 13 according to the present invention is applied via thermal spray coating. In thermal spray coating, a meltable material is melted and sprayed onto a workpiece to be coated in melted form. Plasma spraying is preferably used as thermal spray coating. The manufacturing method according to the present invention is subsequently explained with reference to FIG. 3.

In plasma spraying, an electric arc is ignited between a cathode and an anode of a schematically shown plasmatron 19. This electric arc heats a plasma gas flowing through the plasmatron. Argon, hydrogen, nitrogen, helium, or mixtures of theses gases are used as plasma gases, for example. Due to the heating of the plasma gas, a plasma jet is created whose temperatures can reach up to 20,000° C. in its core.

The powdery material used for the coating, here the above-mentioned CoNiCrAlY material conglutinated with hexagonal boron nitride (hBN) and mixed with polyester, is injected into the plasma jet using a carrier gas and is at least partially melted there. Furthermore, the powder particles are accelerated by the plasma jet to high speed in the direction of the component. The material mixture, melted and accelerated in this way, forms a spray jet 20, spray jet 20 being composed of the plasma jet and the particle jet of the melted material. The particles of the material hit a surface 21 of the workpiece to be coated with great thermal and kinetic energy and form a coating there. The intended coating properties are formed as a function of the parameters of the spray process.

The polyester particles contained in spray jet 20 are incorporated into the coating in a statistically distributed manner and subsequently burned out of the coating in order to leave behind pores 18.

Figure 3:
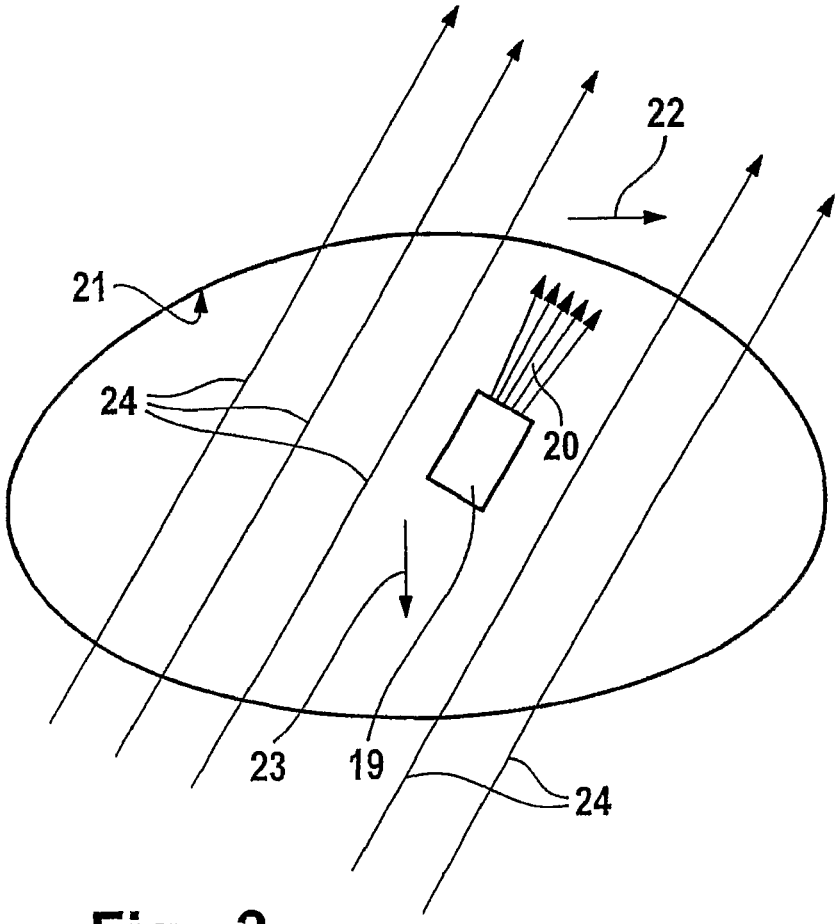
FIG. 3 shows a schematic drawing for clarifying the method according to the present invention.

To provide the running-in coating made of the CoNiCrAlY-hBN material having a Rockwell hardness in the range of 20 to 60, preferably in the range of 35 to 50, the polyester particles, which are predominantly located in the boundary area of the spray jet, are incorporated into the CoNiCrAlY-hBN layer as uniformly as possible. To achieve this, plasma spraying is carried out as follows: A highest possible rotatory and translatory relative speed is established between plasmatron 19 and surface 21 to be coated of the component to be coated. The rotatory relative speed is indicated in FIG. 3 by arrow 22, and the translatory relative speed is indicated by arrow 23. For providing this relative speed it is preferred that plasmatron 19 is translatorily displaced and the component to be coated rotates with respect to plasmatron 19. However, it is also conceivable that plasmatron 19 stands still and only the component to be coated is moved. This rotatory movement ensures that surface 21 to be coated is coated over the entire circumferential direction. The translatory movement ensures that the coating is also complete in the axial direction of the component.

Plasma spraying is preferably carried out in a spray booth. Particles must be continuously removed from the spray booth using an air flow which is indicated in FIG. 3 by arrows 24. It is the object of the present invention that the air flow according to arrows 24 is preferably approximately parallel to the spray direction of spray jet 20. This ensures that all particles of the spray jet, i.e., of the CoNiCrAlY-hBN layer as well as the polyester particles incorporated into the layer, definitely reach surface 21 to be coated.

It has been recognized according to the present invention that maintaining this parallel air flow and providing high rotatory and translatory relative speeds are important to manufacture the running-in coating according to the present invention having the defined Rockwell hardness.

The spray process is monitored and analyzed online. This makes it possible to implement an online process control and online quality assurance of the coating process. Spray jet 20 used during plasma spraying is optically monitored via a camera which may be designed as a CCD camera. The image detected and established by the camera is conveyed to an image processing system. Characteristics of the optically monitored spray jet 20 are ascertained in the image processing system from the data detected by the camera.

The camera detects characteristics of a plasma jet as well as characteristics of a particle jet. The camera preferably ascertains a luminance distribution of the plasma jet as well as a luminance distribution of the particle jet. Isointensity lines of equal luminous intensities are ascertained in the image processing system from these luminance distributions. Ellipses are then preferably written into such isointensity lines of equal luminous intensities. This is carried out for the plasma jet as well as for the particle jet. The ellipses written into the isointensity lines have characteristic geometrical parameters. These geometrical parameters of the ellipses are semiaxes as well as the center of gravity of the ellipses. From these characteristic data of the ellipses, unambiguous conclusions can be drawn on the characteristics of the spray jet and ultimately on the characteristics of the coating occurring during the spray process.

The geometrical parameters of the ellipses, ascertained from optical monitoring of the spray jet which correspond to the characteristics of the spray jet, are compared with predefined values for these characteristics or with predefined ellipse parameters. These predefined ellipse parameters are ascertainable via a correlation between the process parameters of the spray process, the particle characteristics of the melted material, and the characteristics of the resulting coating. If a deviation of the ascertained characteristics of the spray jet from the predetermined values for the characteristics is detected, the spray process may be either aborted or, as a function of this deviation, may be regulated in such a way that the predetermined characteristics of the spray jet are achieved.

In the depicted exemplary embodiment, running-in coating 13 according to the present invention made of the CoNiCrAlY-hBN material having a Rockwell hardness according to the HR 15Y scale in the range between 20 and 60 is directly applied to housing 11. It should be pointed out that an adhesion-boosting layer or an additional layer fulfilling functions such as titanium fire protection or thermal insulation may also be situated between housing 11 and running-in coating 13, which may likewise be applied via plasma spraying.

What is claimed is:

1. A running-in coating for gas turbines for application to a housing of the gas turbine to seal a radial gap between the housing of the gas turbine and rotating blades of the same, the running-in coating comprising CoNiCrAlY-hBN and a polymer.

2. The running-in coating as recited in claim 1, wherein a Rockwell hardness of the running-in coating is in a range of 20 to 60.

3. The running-in coating as recited in claim 2, wherein the Rockwell hardness of the running-in coating is in a range of 35 to 50.

4. The running-in coating as recited in claim 2, wherein the Rockwell hardness is a Rockwell hardness determined on an HR 15Y scale.

5. The running-in coating as recited in claim 1, wherein the polymer is a polyester.

6. A gas turbine, comprising a housing and a plurality of rotating blades defining a radial gap therebetween, the housing having a running-in coating applied thereto, the running in coating including CoNiCrAlY-hBN, the Rockwell hardness of the running-in coating being in a range of 20 to 60.

7. The gas turbine as recited in claim 6, wherein the Rockwell hardness of the running-in coating is in a range of 35 to 50.

8. The gas turbine as recited in claim 6, wherein the Rockwell hardness is a Rockwell hardness determined on an HR 15Y scale.

9. The gas turbine of claim 6, further comprising an intermediate layer between the housing and the running-in coating, the intermediate layer being one of an adhesion-boosting layer, a titanium fire protection layer, and a thermal insulation layer.

10. A method for applying a running-in coating for gas turbines for sealing a radial gap between a housing of the gas turbine and rotating blades of the same, the method comprising:

a. providing a housing; and b. applying a running-in coating to the housing, the running-in coating including CoNiCrAlY-hBN_and a polymer.

11. The method as recited in claim 10, comprising, prior to the applying step, applying an intermediate layer to the housing.

12. The method as recited in claim 11, wherein the intermediate layer is one of an adhesion-boosting layer, a titanium fire protection layer, and a thermal insulation layer.

13. The method as recited in claim 10, wherein the applying step comprises applying the running-in coating via thermal spraying.

14. The method as recited in claim 13, wherein the thermal spraying comprising plasma spraying.

15. The method as recited in claim 13, wherein the thermal spraying is performed with a spray jet, and the applying step comprises thermal spraying the running in coating to the housing while providing a sufficient rotatory and/or translatory relative speed between the spray jet and the housing to provide the running-in coating with a Rockwell hardness of in a range of 20 to 60.

16. The method as recited in claim 13, wherein the thermal spraying is performed with a spray jet, and the applying step comprises thermal spraying the running-in coating such that an air flow, which removes particles from a spray booth, is approximately parallel to the spray jet.

17. The method as recited in claim 13, wherein the thermal spraying is performed with a spray jet, and the applying step comprises optically monitoring one or more characteristics of the spray jet, and controlling the thermal spraying process as a function of the monitored values of the characteristics and predetermined values for the characteristics.

18. The method as recited in claim 17, wherein the one or more characteristics include a luminance distribution of the plasma jet, said luminance distribution being optically monitored with a camera.

19. The method as recited in claim 13, comprising controlling the thermal spraying such that the running-in coating has a Rockwell hardness in a range of 20 to 60 according to the HR 15Y scale.

20. The method as recited in claim 13, comprising controlling the thermal spraying such that the running-in coating has a Rockwell hardness in a range of 35 to 50 according to the HR 15Y scale.

21. The method as recited in claim 10, wherein the polymer is a polyester.

22. The method as recited in claim 10, further comprising burning the polymer out of the running-in coating.

23. The method as recited in claim 10, wherein the applying step includes rotating and translating a sprayer and the housing with respect to one another.

* * * * *